United States Patent [19]

Rossmann et al.

[11] 4,249,466

[45] Feb. 10, 1981

[54] SABOT PROJECTILE HAVING A PYROTECHNIC COMPOSITION

[75] Inventors: Rudolf Rossmann, Züich; Walter Engel, Wallisellen; Günther Diewald, Züich, all of Switzerland

[73] Assignee: Werkzeugmaschinenfabrik Oerlikon-Bührle AG, Zürich, Switzerland

[21] Appl. No.: 921,506

[22] Filed: Jul. 3, 1978

[30] Foreign Application Priority Data

Jul. 21, 1977 [CH] Switzerland ..... 9055/77

[51] Int. Cl.[1] ..... F42B 11/16

[52] U.S. Cl. ..... 102/60; 102/87; 102/93

[58] Field of Search ..... 102/60, 93, 87, 90, 102/66

[56] References Cited

U.S. PATENT DOCUMENTS

| | | | |
|---|---|---|---|
| 3,349,712 | 10/1967 | Schwager et al. | 102/93 |
| 3,435,768 | 4/1969 | Engel | 102/93 |
| 3,765,336 | 10/1973 | Kulsik | 102/87 |
| 3,972,291 | 11/1974 | Braun, Jr. | 102/87 |

FOREIGN PATENT DOCUMENTS

| | | | |
|---|---|---|---|
| 647718 | 10/1962 | Italy | 102/60 |
| 709843 | 6/1954 | United Kingdom | 102/60 |

*Primary Examiner*—Harold J. Tudor
*Attorney, Agent, or Firm*—Werner W. Kleeman

[57] ABSTRACT

A sabot projectile having a pyrotechnic composition, especially a flare composition, arranged at the projectile body, wherein only a part of the pyrotechnic composition protrudes into a recess adapted to receive the same and provided at the tail of the projectile body. The part of the pyrotechnic composition protruding out of the tail of the projectile body is surrounded by a shell or jacket.

2 Claims, 7 Drawing Figures

1
3b
2
12
2b
3
2a
17
7
13
30
3a
6
8
3c
11
3d
16
10
9

SABOT PROJECTILE HAVING A PYROTECHNIC COMPOSITION

BACKGROUND OF THE INVENTION

The present invention relates to a new and improved sabot projectile, also referred to in the art as a subcaliber projectile, which is of the type having a pyrotechnic composition, especially a flare composition, arranged at the projectile body.

In the case of sabot projectiles the flare composition is usually embedded in a bore at the tail portion of the projectile body, such as has been disclosed for instance in Swiss Pat. No. 461,309.

Since the projectile body usually is formed of a heavy metal, the installation of the comparatively light flare composition results in a reduction in the weight of the projectile body. This means that the projectile body having such type mounted flare composition has a lesser penetration force than a projectile devoid of any flare composition. Additionally, the material which is removed during the fabrication of the bore constitutes a considerable loss, particularly, in consideration of the high price of heavy metal.

SUMMARY OF THE INVENTION

Hence, it is a primary object of the present invention to provide a new and improved construction of sabot projectile having a pyrotechnic composition which is not associated with the aforementioned drawbacks and limitations of the prior art constructions.

Another and more specific object of the present invention aims at the provision of a new and improved construction of a sabot projectile having a pyrotechnic composition, wherein there can be avoided the material loss at the projectile body and there is increased the effectiveness of the projectile.

Now in order to implement these and still further objects of the invention, which will become more readily apparent as the description proceeds, the invention contemplates that only a part of the pyrotechnic composition protrudes into a recess provided at the tail portion or rear part of the projectile body intended to receive the pyrotechnic composition. Further, the part of the pyrotechnic composition which protrudes out of the tail portion or rear part of the projectile body is surrounded by a jacket or shell.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
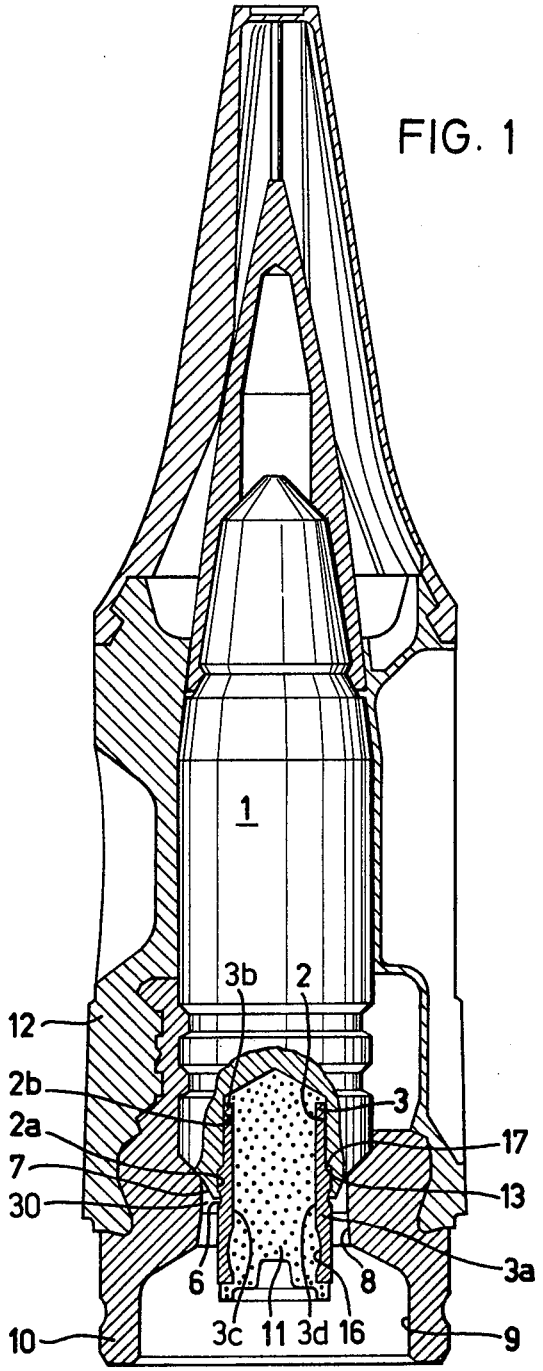
FIG. 1 is a longitudinal sectional view of a sabot projectile constructed according to the teachings of the present invention.

Describing now the drawings, according to the exemplary embodiment of sabot projectile shown in FIG. 1 there is provided a projectile body 1 of the sabot projectile which has a recess 2 at the tail or rear portion 30 of such projectile body 1. This recess 2 is constructed as a coaxial blindhole bore with regard to the lengthwise axis of the projectile body 1 and has two sections or portions 2*a* and 2*b* of different diameter. Into such recess 2 there is inserted only part of a flare composition 11. This flare composition 11 is surrounded by a jacket or shell 3. This jacket or shell 3 is also shown in the following exemplary embodiments, for instance, as a tubular section or piece. The front part 3*b* of this jacket or shell 3 which is stepped in diameter is inserted with a press fit in the narrower part 2*b* of the recess 2. A shoulder 17 of the jacket or shell 3 bears against a shoulder 13 of the projectile body 1. The rear part 3*a* of the jacket or shell 3 possesses an annular or ring-shaped groove 6 where there is flanged a thin-wall collar 7 of the projectile body 1. The shell or jacket 3 having a bore which is continuous and of the same diameter, protrudes from the tail portion or rear part 30 of the projectile body 1 towards the rear into a central bore 8 of the tail portion 30 of such sabot projectile and past such central bore 8. This central bore 8 merges with a recess 9 of the aforesaid-tail portion 30. Since the jacket or shell 3 is held by means of a press fit, there is effectively prevented that upon firing of the projectile propellant charge gases will penetrate into the recess portion 2*b*, ignite the flare composition 11 at its front end and therefore cause such to be ejected rearwardly out of the jacket or shell 3.

In order to avoid any premature ignition of the flare composition 11 such is not pressed into the shell or jacket 3 which is already secured at the projectile body 1 before there has been applied a projectile jacket or casing 12 of plastic material which is molded at a working temperature of about 570° K. During the pressing-in operation, the flare composition 11 also fills a substantially ring-shaped groove 16 cut in the bore wall 3*d* of the jacket or shell 3, so that this flare composition 11 can be effectively anchored within the bore 3*c* of the jacket 3.

Figure 2:
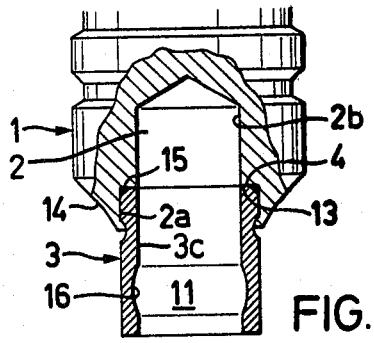
FIGS. 2, 3, 4, 5, 6 and 7 show on an enlarged scale respective longitudinal sectional views through the tail portion or rear part of respective variant constructions of projectile bodies designed according to the teachings of the present invention.

There now will be considered the modified arrangements of the invention shown in FIGS. 2 to 7, wherein there have been generally used the same reference characters throughout for indicating the same or analogous components. With the embodiment of FIG. 2 an end surface 4 of the shell or jacket 3 bears at a shoulder 13 separating both sections or parts 2*a* and 2*b* of the recess 2 of the projectile body 1 from one another. A part of the flare composition 11 which has not been further illustrated in the showing of FIG. 2, is therefore arranged in the jacket or shell 3 and the other part in the recess portion or section 2*b* of the projectile body 1 which has the same diameter as the bore 3*c* of the jacket 3. Since in this case the jacket 3 is arranged at the region of a conical support surface 14 of the projectile body 1, it cannot be inserted with a press fit into the recess portion or section 2*a*, in order to avoid any rupture of the projectile body 1. A sealing means 15 arranged between the end surface 4 of the jacket 3 and the shoulder 13 prevents the penetration of propellant charge gases into the section 2*b* of the recess 2.

Figure 3:
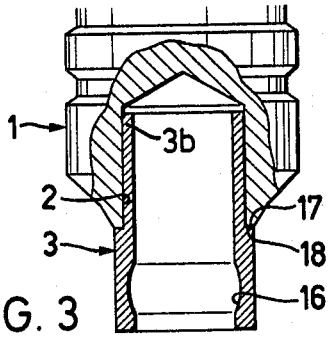

With the modified construction of FIG. 3 the projectile body 1 has a recess 2 which is not stepped in diameter, and the diameter of which corresponds to the diameter of the front portion 3*b* of the jacket 3. Consequently, it is possible to secure the jacket 3 with a press fit in the recess 2 of the projectile body 1 without any danger of rupture of such projectile body 1. The shoulder 17 of the jacket 3 bears against a substantially ring-shaped or annular tail or rear surface 18 of the projectile body 1.

Figure 4:
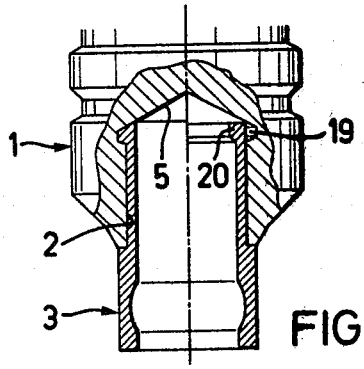
Figure 5:
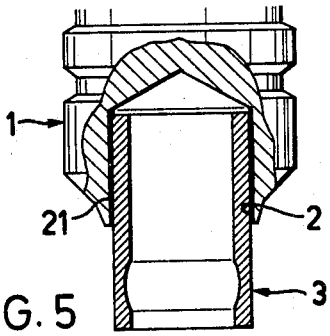

With the embodiment of FIG. 4 the recess 2 of the projectile body 1 has at its front end a substantially ring-shaped groove 19. The jacket 3, as best seen in the right-hand half of the showing of FIG. 4, in its original state has an inwardly directed flange edge 20. In order to attach the jacket or shell 3 the flange edge 20 is forced by plastic deformation, as shown for the left-hand half of the showing of FIG. 4, into the groove 19 and against the base 5 of the recess 2. Hence, the recess 2 is sealed against the penetration of propellant charge gases and the jacket 3 is anchored in the projectile body 1. The jacket 3 also can be secured by an adhesive bond in the recess 2 of the projectile body 1. In FIG. 5 there is shown an adhesive layer generally designated by reference character 21, producing such adhesive bond, this adhesive layer 21 being constituted for instance by the commercially available adhesive known under the trademark "Araldit" or may be a hard solder layer.

Figure 6:
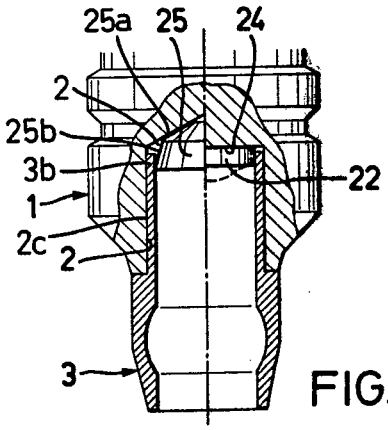

According to the right-hand side of the showing of FIG. 6, with a further embodiment, the jacket or shell 3 is anchored by a disc or plate 22 in the recess 2 of the projectile body 1. This disc 22 in its original state, as shown at the right-hand side of FIG. 6 in broken lines, is slightly domed and has a diameter which is equal to the inner diameter of the jacket or shell 3. This disc 22 is pressed flat against the base 24 of the recess 2. During the resultant radial expansion of the disc 22 the front end **3*b* of the jacket 3 is pressed against the wall 2*c* of the recess 2 and fixedly retained therein. According to the left-hand portion of the showing of FIG. 6 the jacket 3 is retained by a displacement body 25 in the recess 2 of the projectile body 1. Such can be constructed to be solid or as a shell. Two of its outer boundary surfaces are conical, and specifically, the one boundary surface 25*a* has the same aperture or cone angle as the base of the recess 2 and thereafter there merges the other boundary surface 25*b* having a smaller aperture or flare angle. The largest diameter of this displacement body 25 is somewhat greater than the inner diameter of the jacket or shell 3. Thus, during insertion of the displacement body 25 there is caused a radial expansion of the jacket 3, and thus the latter is fixedly clamped between the wall 2*c* of the recess 2 and the displacement body 25**.

Figure 7:
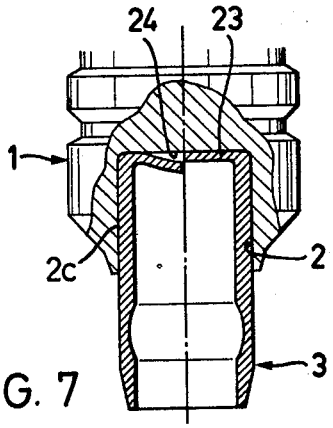

According to the showing of FIG. 7 the jacket or shell 3 is closed at its front by a cover 23. The base 24 of the recess 2 of the projectile body 1, into which there has been inserted the jacket or shell 3, is for instance aligned perpendicular to the lengthwise axis of the projectile body 1, but however also can be conical. In the end state the cover or cover member 23 of the jacket 3 bears against the base 24 of the recess 2. In the original state the cover 23 is not flat or planar, rather domed in the direction towards the interior of the jacket or shell 3. The cover 23 is pressed against the base of the recess 2 while exerting a force sufficient for plastic deformation. In this way there are prevented hollow spaces which otherwise could arise owing to differences in tolerance between the recess 2 and the jacket 3. These hollow spaces, upon firing of the projectile and during its passage through the weapon barrel, could fill with propellant charge gas which, after exit of the projectile out of the weapon barrel, expand and could rearwardly eject the flare composition 11 out of the projectile body 1. Due to the radial expansion which the jacket or shell 3 experiences during pressing flat the cover member 23, the jacket 3 is beneficially pressed against the bore wall **2*c***.

The amount by which the jacket or shell 3 can protrude past the tail surface of the projectile body 1 must be determined by experimentation. After the separation of the projectile body 1 and the sabot 10 the jacket 3 still initially must move out of the bore 8 of the sabot 10. Since, however, the sabot 10, immediately following the separation, departs from the prior common trajectory described with the projectile body 1, the jacket 3 can only protrude such an extent that there is effectively prevented any contact with the sabot 10 following the separation. Otherwise, the hit accuracy would be impaired. The fact that there is no intermediate space between the flare composition 11 and the base of the recess 5 additionally affords the advantage that the jacket 3 is not loaded by the propellant gases. In particular, the gas pressure can be effective at the base of the recess 2 by means of the flare composition 11, and thus directly at the projectile body 1.

The jacket 3 which protrudes from the tail portion 30 of the projectile body 1 additionally has a beneficial effect as concerns the aerodynamic properties of the projectile body 1.

Of course, it is possible also to equip in this manner projectiles without any sabot with flare compositions 11. The inventive construction equally encompasses the application of a different pyrotechnic composition instead of the flare composition, for instance a smoke composition.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A sabot projectile comprising:

a projectile body having a tail portion;

a flare composition provided for the projectile body;

said tail portion of the projectile body having a recess possessing a base;

only part of the flare composition protruding into the recess of the tail portion of the projectile body;

a tubular jacket opened at both ends secured in the recess and extending toward the base of the recess, said jacket surrounding the part of the flare composition protruding out of the tail portion of the projectile body;

said tubular section having an inner surface provided with a ring-shaped groove; and the flare composition being in direct contact with and anchored in said ring-shaped groove and extending forward of said jacket to completely fill said recess.

2. The projectile as defined in claim 1, further including:

means for attaching the jacket in the recess.

* * * * *